US005110002A

United States Patent [19]

Tucker

[11] Patent Number: 5,110,002

[45] Date of Patent: May 5, 1992

[54] PROTECTIVE CAP WITH SEAL FOR BEVERAGE CONTAINER

[76] Inventor: Terence Tucker, 33811 Shannon La., San Juan Capistrano, Calif. 92675

[21] Appl. No.: 620,836

[22] Filed: Jan. 22, 1991

Related U.S. Application Data

[63] Continuation-in-part of Ser. No. 598,175, Oct. 15, 1990, Pat. No. 5,054,640.

[51] Int. Cl.[5] ..... B65D 51/18

[52] U.S. Cl. ..... 220/254; 220/344; 220/713; 220/717

[58] Field of Search ..... 220/306, 90.2, 90.4, 220/254, 307, 344, 703, 711, 713, 716, 717, 718; 215/237

[56] References Cited

U.S. PATENT DOCUMENTS

| | | | |
|---|---|---|---|
| D. 146,355 | 2/1947 | Guarnaschelli | D58/26 |
| D. 200,820 | 4/1965 | Blakslee | D58/26 |
| D. 258,496 | 3/1981 | Ludwig et al. | D9/439 |
| 1,463,892 | 8/1923 | Ingram et al. . | |
| 2,754,866 | 7/1956 | Coltman, Jr. . | |
| 2,764,199 | 9/1956 | Tupper . | |
| 2,764,200 | 9/1956 | Gits | 220/254 |
| 3,005,571 | 10/1961 | Hall | 220/254 X |
| 3,187,919 | 6/1965 | Inglis | 215/39 |
| 3,202,448 | 8/1965 | Stern et al. | 294/87.2 |
| 3,224,575 | 12/1965 | Whiteford | 206/65 |
| 3,250,564 | 5/1966 | Stern et al. | 294/87.2 |
| 3,281,180 | 10/1966 | Spery | 294/87.2 |
| 3,310,334 | 3/1967 | Murphy | 294/87.28 |
| 3,350,131 | 10/1967 | Tanzer | 294/87.2 |
| 3,362,572 | 1/1968 | Pelley . | |
| 3,372,832 | 3/1968 | Yeater et al. . | |
| 3,421,654 | 1/1969 | Hexel . | |
| 3,510,021 | 5/1970 | Silver | 215/9 |
| 3,583,591 | 6/1971 | Hayashida | 315/40 |
| 3,589,509 | 6/1971 | Mascia et al. | 206/65 |
| 3,601,439 | 8/1971 | Poupitch | 294/87.2 |
| 3,737,066 | 6/1973 | Ames . | |
| 3,744,655 | 7/1973 | Nixdorff, Jr. | 215/9 |
| 4,098,439 | 7/1978 | Blow, Jr. et al. | 222/531 |
| 4,361,250 | 11/1982 | Foster | 220/254 X |
| 4,420,089 | 12/1983 | Walker et al. | 215/237 X |
| 4,537,326 | 8/1985 | Morehead | 220/269 |
| 4,564,116 | 1/1986 | Prohaska | 215/256 |
| 4,721,222 | 1/1988 | Haythornthwaite | 220/234 |
| 4,790,444 | 12/1988 | Terzi | 220/90.2 |
| 4,796,774 | 1/1989 | Nabinger | 220/90.4 |
| 4,807,768 | 2/1989 | Gach | 215/237 X |
| 4,869,389 | 9/1989 | Cerrone, Jr. | 220/90.2 |
| 4,874,103 | 10/1989 | Quisenberry et al. | 220/254 |
| 4,883,192 | 11/1989 | Krugman | 220/90.4 X |
| 4,938,379 | 7/1990 | Kellner | 220/370 |
| 4,961,510 | 10/1990 | Dvoracek | 220/90.4 |
| 4,989,746 | 2/1991 | Pierce | 220/254 |

*Primary Examiner*—Stephen Marcus
*Assistant Examiner*—Nova Stucker
*Attorney, Agent, or Firm*—Stetina and Brunda

[57] ABSTRACT

A protective cap having a sealable cover for canned soft drinks and the like is disclosed. The cap comprises an outer periphery configured to receive and snap over a conventional beverage can, a grate positioned to cover the opening in the top of the can through which the beverage may be consumed, and a hingeable cover having a seal which can be rotated between opened and closed positions to permit consumption of the beverage when in the open position and to seal the container when in the closed position. The sealing of the container prevents contamination of the enclosed beverage and seals in carbonation. It also prevents spillage if the container is overturned. A detent formed upon the lower surface of the cover is received between adjacent bars of the grate to latch the cover in the closed position.

5 Claims, 1 Drawing Sheet

PROTECTIVE CAP WITH SEAL FOR BEVERAGE CONTAINER

RELATED APPLICATIONS

This application is a continuation in part of pending U.S. application Ser. No. 07/598,175, filed on Oct. 15, 1990, now U.S. Pat. No. 5,054,640 hereby incorporated by reference.

FIELD OF THE INVENTION

The present invention relates generally to caps for beverage containers, and more particularly to a protective cap for canned soft drinks, beer, fruit juices, and the like which both prevents contamination of the beverage and seals in carbonation.

BACKGROUND OF THE INVENTION

Protective caps which prevent insects and other contamination from entering beverage containers while permitting consumption of the beverage contained therein are well known. A grating or similar set of apertures typically permits consumption of the beverage while preventing bees and other insects, lured by the sugar content of the beverage, from entering the container. Such prior art protective caps generally snap over the upper end of a soft drink container such that an opening defined by the grate is positioned directly over the opening in the container. Thus, the user can consume the beverage by drinking the liquid directly from the container through the protective cover. The problem of insects, particularly bees, entering sugar-sweetened soft drinks and the like is common, particularly when such soft drinks are consumed outdoors. Besides being unappetizing and generally ruining the soft drink, such occurrences can be dangerous in that they may result in a bee sting or other insect bite or sting. In fact, there are cases where a bee sting inside the mouth or throat has caused death.

Caps for sealing carbonation within a soft drink contained within a can are likewise well known. Such caps typically fit directly within the opening of the soft drink container and are provided with a mechanism which permits them to clamp down and thus seal the opening in a gas-tight fashion.

The problem of leakage of carbonation from carbonated soft drinks and the like has long been recognized. This problem is often encountered when a portion of a soft drink is consumed and the remainder is then stored for consumption at a later time. Since the opened beverage can does not provide a gas-tight container, vapor pressure cannot build up within the can to prevent the boiling off of carbonic acid. This loss of carbonic acid from the soft drink results in a corresponding loss of the customary fizz due to lack of carbonation. Since it is desirable to retain the carbonation of an opened soft drink, it would be desirable to provide a means for doing so which also provides the user with the above-mentioned benefits in relation to a protective cap.

Another problem associated with the use of contemporary soft drink containers is spillage. Although a prior art carbonation seal prevent spillage if the container were accidently overturned, the prior art carbonation seal is simply too cumbersome to use during consumption. It would thus only provide spill protection during storage of an unconsumed portion of a beverage, i.e. when the carbonation seal is actually installed upon the container.

While such prior art protective covers do serve adequately to prevent bees and other large insects from entering the beverage container while permitting consumption of the beverage and such prior art carbonation seals do seal carbonation within the beverage, no single device is known which accomplishes both tasks. Additionally, the prior art protective covers are inadequate in preventing smaller insects, e.g., ants, mosquitoes and gnats, from entering the can. Furthermore, the prior art carbonation seals cannot be utilized without removing them from the container. It will be desirable to provide a single protective cover which prevents both large and small insects from entering the container, which could be used to seal carbonation within the soft drink, which would prevent spills, and which can also be used without removing the cap from the container.

SUMMARY OF THE INVENTION

The present invention specifically addresses and alleviates the above-mentioned deficiencies associated in the prior art. More particularly, a protective cap for soft drinks and the like is disclosed which comprises an outer periphery configured to receive and snap over a conventional beverage can and to provide a gas-tight seal thereto, a grate positioned to cover the opening in the top of the can through which the beverage may be consumed, and a hinged cover having a seal which can be manipulated between opened and closed positions to permit consumption of the beverage when in the open position and to seal the container when in the closed position. The grate prevents larger insects, such as bees, from entering the containers. The hinged cover of the container both prevents contamination of the enclosed beverage by smaller insects and air-borne debris and also seals in carbonation. The hinged cover also prevents spills when in the closed position. A detent formed upon the lower surface of the cover is received between adjacent bars of the grate to latch the cover in the closed position and thus assure a gas-tight seal.

Disposing the hinged cover in the closed position compresses the seal and thus provides a gas-tight closure which retains the carbonation of the beverage contained therein.

Since the hinged cover can be easily rotated between the opened and closed positions, it provides a convenient means for preventing spillage of the beverage in the event that the can is accidently overturned. The hinged cover can easily be rotated to the closed position after a drink is taken, and then returned to the open position when the next drink is desired.

These, as well as other advantages of the present invention will be more apparent from the following description and accompanying drawings. It is understood that changes in the specific structure shown and described may be made within the scope of the claims without departing from the spirit of the invention.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Figure 1:
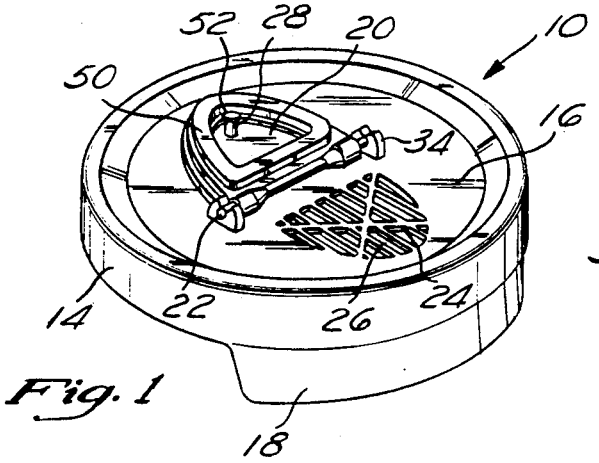
FIG. 1 is a perspective view of the protective cap having a sealable cover of the present invention.
Figure 2:
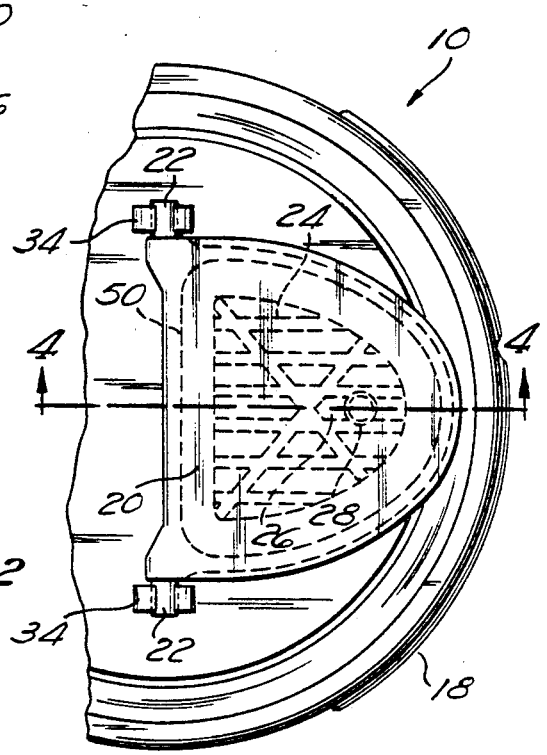
FIG. 2 is an enlarged sectional top plan view of the protective cap showing the hinged cover in the closed position and showing the seal, post, and grate in phantom lines.
Figure 3:
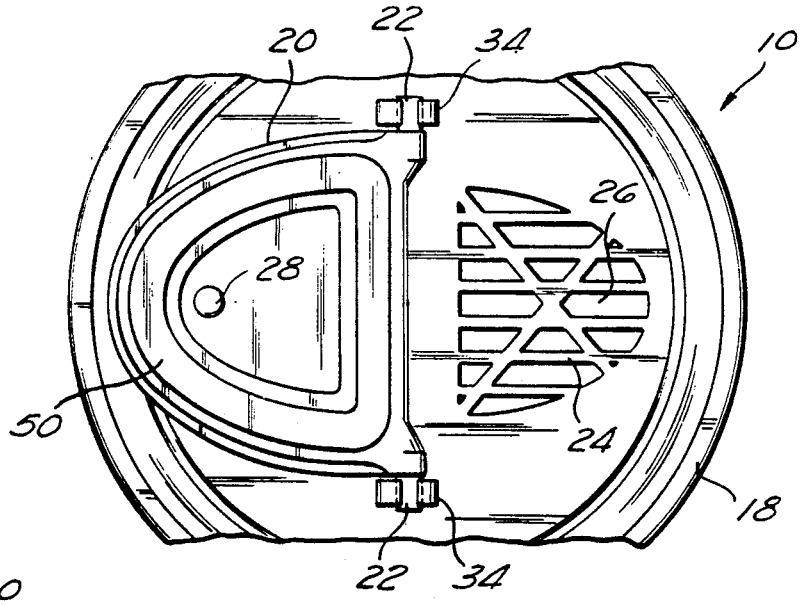
FIG. 3 is an enlarged sectional top plan view of the protective cap of the present invention showing the hinged cover disposed in an opened position.
Figure 4:
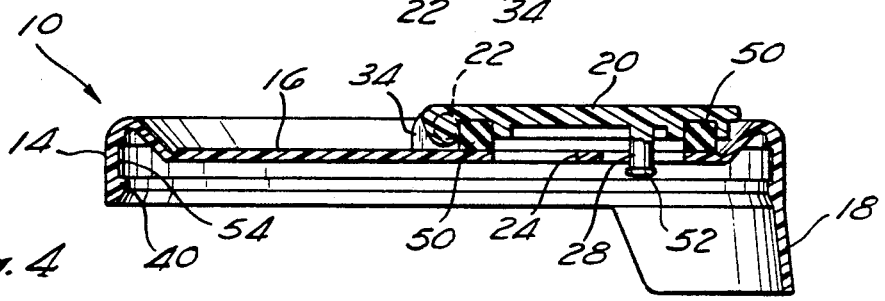
FIG. 4 is a cross-sectional side view of the protective cap with seal showing the cap disposed in a closed position.

The protective cap or seal of the present invention is illustrated in FIG. 1–4 which depict a presently preferred embodiment of the invention. As shown, the protective cap is comprised generally of an outer periphery 14, a top planar surface 16, hinged cover 20, a grate 24, a post 28, and a compressible seal 50. The protective cap 10 is sized and configured to receive and snap over the upper lip of a soft drink container, thereby being frictionally retained thereon and providing a gas-tight seal thereto. A lip guard 18 extends axially downward from the outer periphery 14 to provide a sanitary drinking surface such that the user's mouth need not come into direct contact with the beverage container. A more detailed description of the basic structure and function of the protective cap is provided in U.S. copending patent application Ser. No. 07/598,175, filed by the subject inventor on Oct. 15, 1990, the disclosure of which is expressly incorporated herein by reference.

The hinged cover 20 is rotatable between opened (FIGS. 1 and 3) and closed (FIGS. 2 and 4) positions. Pivot pins 22 are captured within sockets 34 to permit pivotal motion of the hinged cover 20.

An annular groove detent 40 (shown in FIG. 4) extends below the upper rim of a beverage can and cooperates with annular groove 54 (shown in FIG. 4) to provide a gas-tight seal about the top of the can. The groove 54 is sized to fit tightly over the upper rim of a beverage can to insure an adequate seal.

In the opened position, the user may drink beverage from a container through the grate 24. In the closed position, the post 28 engages aperture 26 of the grate 24 such that the seal 50 is compressed to provide an gas-tight closure. Those skilled in the art will recognize that various rubbers and flexible plastics such as those commonly used in O-ring seals are suitable for use as the compressible seal 50 of the present invention.

The post 28 may be flared or mushroomed at its distal end to form a detent 52 to ensure the positive engagement of the post 28 with the grate 24 and to maintain compression of the seal 50 when the hinged cover 20 is in the closed position.

To use the protective cap 10 with the seal of the present invention, the user opens the can and then snap the cap onto the upper end thereof. The hinged cover 20 may remain in the opened position as long as there is no danger of the beverage becoming contaminated by small insects or air-borne debris. The hinged cover 20 is closed when the user encounters environments comprised of blowing dirt, sand, or the like, or when small insects are present. Alternatively, the user may dispose the hinged cover 20 in the closed position between drinks to prevent spills.

For example, when consuming a beverage out-of-doors, the user may dispose the hinged cover 20 in the closed position prior to setting the container upon the ground between drinks. This would prevent ants and other small insects from crawling into the container. It would also prevent spillage of the beverage if the container were accidentally overturned.

If the user decides not to finish the beverage, then the beverage may be stored within the container by disposing the rotatable cover 20 in the closed position to seal in carbonation. Thus, the beverage will not taste "flat" when consumed at a later time.

It is understood that the exemplary protective cap with sealable cover described herein and shown in the drawings represents only a presently preferred embodiment of the invention. Indeed, various modifications and additions may be made to such embodiment without departing from the spirit and scope of the invention. For example, the seal need not be disposed on the hinged cover as illustrated and described, but rather may be disposed anywhere intermediate the cover end top surface of the cap, e.g. upon the surface of the cap, such that gases are prevented from escaping through the grate when the cover is in the closed position. Also, various detent means are contemplated. Thus, these and other modifications and additions may be obvious to those skilled in the art and may be implemented to adapt the present invention for use in a variety of applications.

What is claimed is:

1. A protective cap for preventing insects, airborne debris, and the like from entering a beverage container, for preventing spillage, and for sealing carbonation within the container, the cap comprising:

(a) a generally planar surface having a peripheral portion formed thereabout, said generally planar surface having an opening formed therein, said peripheral portion having a detent formed thereabout for engaging the rim of a beverage can such that said protective cap is removably attachable to a beverage can such that a gas-tight seal is provided at the periphery of said cap between said cap and said can;

(b) a cover hingeably attached to said cap such that said cover can be rotated between an opened position and a closed position of said opening;

(c) a compressible seal disposed in a groove formed in the lower surface of said cover; and (d) a detent means formed upon one of said planar surface and said cover for engaging said cover in a closed position such that said seal is sufficiently compressed to provide a gas-tight closure.

2. A protective cap for preventing insects, airborne debris, and the like from entering a beverage container, for preventing spillage, and for sealing carbonation within the container, the cap comprising:

(a) a generally planar surface having a peripheral portion formed thereabout, said generally planar surface having an opening formed therein, said generally planar surface removably attachable to a beverage can such that a gas-tight seal is provided at the periphery of said cap between said cap and said can;

(b) a cover hingeably attached to said cap such that said cover can be rotated between an opened position and a closed position of said opening;

(c) a compressible seal disposed intermediate said cover and said generally planar surface when said cover is disposed in a closed position;

(d) a detent means formed upon one of said planar surface and said cover for engaging said cover in a closed position such that said seal is sufficiently compressed to provide a gas-tight closure;

(e) a groove formed in said cover; and (f) wherein a portion of said seal is disposed within said groove.

3. The protective cap as recited in claim 2 further comprising a grate formed within said opening.

4. The protective cap as recited in claim 3 wherein said detent means comprises a post formed upon said cover, said post having a detent formed upon the distal end thereof, said post cooperating with said grate to engage said cover in a closed position such that said seal is compressed and a gas-tight closure is formed.

5. A protective cap for preventing insects, airborne debris, and the like from entering a beverage container, for preventing spillage and for sealing carbonation within the container, the cap comprising:

(a) a general planar surface;

(b) a peripheral portion formed substantially perpendicular to said generally planar surface at the periphery of said generally planar surface, said peripheral portion having a detent formed thereon for releasably attaching the protective cap to a beverage container and also having a groove formed therein for receiving the upper rim of a soft drink container, said detent cooperating with said groove to form a gas-tight seal between said cap and said can;

(c) an opening formed in said generally planar surface;

(d) a grate formed within said opening;

(e) a cover hingeably attached to said generally planar surface such that said cover can be rotated between an opened position and a closed position, said cover having a groove formed about the periphery of the lower surface thereof;

(f) a compressible seal, a portion of said seal disposed within said groove; and (g) a post formed upon the lower surface of said cover, said post having a detent formed upon the distal end thereof, said post cooperating with said grate to engage said cover in a closed position such that said seal is compressed and a gas-tight closure is formed.

* * * * *